US005595160A

United States Patent [19]

Matsumoto et al.

[11] Patent Number: 5,595,160

[45] Date of Patent: Jan. 21, 1997

[54] FUEL SUPPLY SYSTEM AND DELIVERY PIPE FOR USE IN SAME

[75] Inventors: Tatsuya Matsumoto, Kariya; Kazuhiro Shinomiya, Aichi-ken; Masaaki Tanaka, Tsu; Mikio Torii, Hekinan, all of Japan

[73] Assignee: Nippondenso Co., Ltd., Kariya, Japan

[21] Appl. No.: 422,523

[22] Filed: Apr. 13, 1995

[30] Foreign Application Priority Data

Apr. 13, 1994 [JP] Japan ..... 6-074736

[51] Int. Cl.[6] ..... F02M 55/02; F02M 37/04

[52] U.S. Cl. ..... 123/456; 123/516

[58] Field of Search ..... 123/456, 468, 123/469, 470, 516, 514

[56] References Cited

U.S. PATENT DOCUMENTS

| | | | |
|---|---|---|---|
| 4,294,215 | 10/1981 | Hans et al. | 123/470 |
| 4,570,602 | 2/1986 | Atkins et al. | 123/456 |
| 5,076,242 | 12/1991 | Parker | 123/516 |
| 5,080,069 | 1/1992 | Hudson, Jr. | 123/456 |
| 5,095,876 | 3/1992 | Yonekawa et al. | 123/456 |
| 5,325,838 | 7/1994 | Bennett | 123/541 |
| 5,333,587 | 8/1994 | Disilvestro et al. | 123/456 |
| 5,359,976 | 11/1994 | Nakashima et al. | 123/456 |
| 5,408,971 | 4/1995 | Jaeger et al. | 123/456 |

*Primary Examiner*—Thomas N. Moulis
*Attorney, Agent, or Firm*—Cushman Darby & Cushman IP Group of Pillsbury Madison & Sutro, LLP

[57] ABSTRACT

In a fuel supply system, pressurized fuel is supplied to a delivery pipe from a fuel tank and distributed to fuel injection valves. The delivery pipe includes a main pipe in which upper and lower chambers are defined by a partition wall. One of the fuel injection valves is capable of receiving fuel from both the upper and lower chambers via a particular passage, while the other fuel injection valves are arranged to receive the fuel only from the lower chamber. Bubbles are supplied only to that one fuel injection valve and discharged therethrough. Accordingly, the other fuel injection valves can achieve the normal fuel injection even when the bubbles are present in the delivery pipe. It may be arranged that the partition wall may be omitted. It may further be arranged that the fuel supplied to the delivery pipe is prohibited from returning to the fuel tank and thus is all supplied to an engine via the fuel injection valves.

17 Claims, 7 Drawing Sheets

FUEL SUPPLY SYSTEM AND DELIVERY PIPE FOR USE IN SAME

BACKGROUND OF THE INVENTION

1. Field of the Invention

The present invention relates to a fuel supply system for supplying fuel to an internal combustion engine, and more specifically, to a device for distributing the fuel to a plurality of engine cylinders.

2. Description of the Prior Art

In automotive vehicle engines or other power engines, fuel injection systems for supplying pressurized fuel in an injected manner have been widely used. In the fuel injection systems of this type, in general, pressurized fuel in a delivery pipe having a given volume is distributed to a plurality of fuel injection valves and then injected into an intake passage of each engine cylinder or into a combustion chamber of each cylinder. Such fuel injection systems have been applied to gasoline engines and diesel engines. In general, in these fuel injection systems, a pressure regulator is provided for adjusting a fuel pressure in the delivery pipe to a given value. Specifically, when the fuel pressure in the delivery pipe exceeds the given value, the pressure regulator is opened to return an excess portion of the fuel to a fuel tank.

However, the excess fuel returned to the fuel tank from the delivery pipe provided near the engine is in general, increased in temperature due to heat of the engine so that it tends to generate fuel vapor. Further, since the excess fuel is subjected to a pressure reduction from a high-pressure state in the delivery pipe to a low-pressure state in the fuel tank, it further tends to generate the fuel vapor.

Further, in the foregoing fuel injection systems, in order to prevent the fuel vapor from being discharged from the fuel tank into the atmosphere, a canister is required for collecting the fuel vapor, which leads to complexity in structure and increment in cost of the whole system.

On the other hand, it has been proposed to omit the pressure regulator and prohibit the return of the excess fuel to the fuel tank so as to suppress generation of the fuel vapor.

However, when return of the excess fuel is prohibited, bubbles of air enter the delivery pipe or bubbles of the fuel vapor generated in the delivery pipe remain in the delivery pipe. These gas components reduce a supply amount of the fuel as liquid so as to impede an stable operation of the engine and deteriorate exhaust gas emissions.

SUMMARY OF THE INVENTION

Therefore, it is an object of the present invention to provide an improved fuel supply system.

It is another object of the present invention to provide an improved delivery pipe for use In a fuel supply system.

According to one aspect of the present invention, a fuel supply system for supplying pressurized fuel to an internal combustion engine comprises a gas-liquid separation chamber introduced with the pressurized fuel and separating liquid components and gas components contained in the pressurized fuel; fuel outlet means, communicating only with a lower area of the gas-liquid separation chamber, for supplying the fuel to the engine; and a passage member communicating with both an upper area of the gas-liquid separation chamber and the lower area and supplying the fuel to the engine from both the upper and lower areas, the passage member having a first opening establishing communication between an interior of the passage member and the upper area, a second opening establishing communication between the interior and the lower area, and an outlet opening from the interior, the passage member supplying the fuel to the engine via the outlet opening.

According to another aspect of the present invention, a delivery pipe for distributing pressurized fuel to first and second fuel injection valves arranged at a given interval therebetween comprises an inlet portion introduced with the pressurized fuel; a first chamber communicating with an upper portion of the inlet portion; a second chamber communicating with a lower portion of the inlet portion and extending over the first and second fuel injection valves; a first fuel outlet portion communicating only with the second chamber and supplying the fuel from the second chamber to the first fuel injection valve; and a second fuel outlet portion communicating with both the first and second chambers and supplying the fuel from both the first and second chambers to the second fuel injection valve.

According to another aspect of the present invention, a delivery pipe for distributing pressurized fuel to a plurality of fuel injection valves comprises a tubular main pipe formed of an aluminum alloy by extrusion, the main pipe having an interior which is divided by a partition wall into first and second chambers, the first chamber being located above the second chamber when the main pipe is mounted to an engine; a closure member closing the first and second chambers at an end of the main pipe; an inlet pipe introduced with the pressurized fuel, the inlet pipe connected to the main pipe so as to communicate with both the first and second chambers; a first fuel outlet portion provided at the main pipe, the first fuel outlet portion communicating only with the second chamber so as to supply the fuel from the second chamber to a first fuel injection valve; and a second fuel outlet portion provided at the main pipe, the second fuel outlet portion communicating with both the first and second chambers so as to supply the fuel from both the first and second chambers to a second fuel injection valve.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT

Now, preferred embodiments of the present invention will be described with reference to the accompanying drawings.

Figure 1:
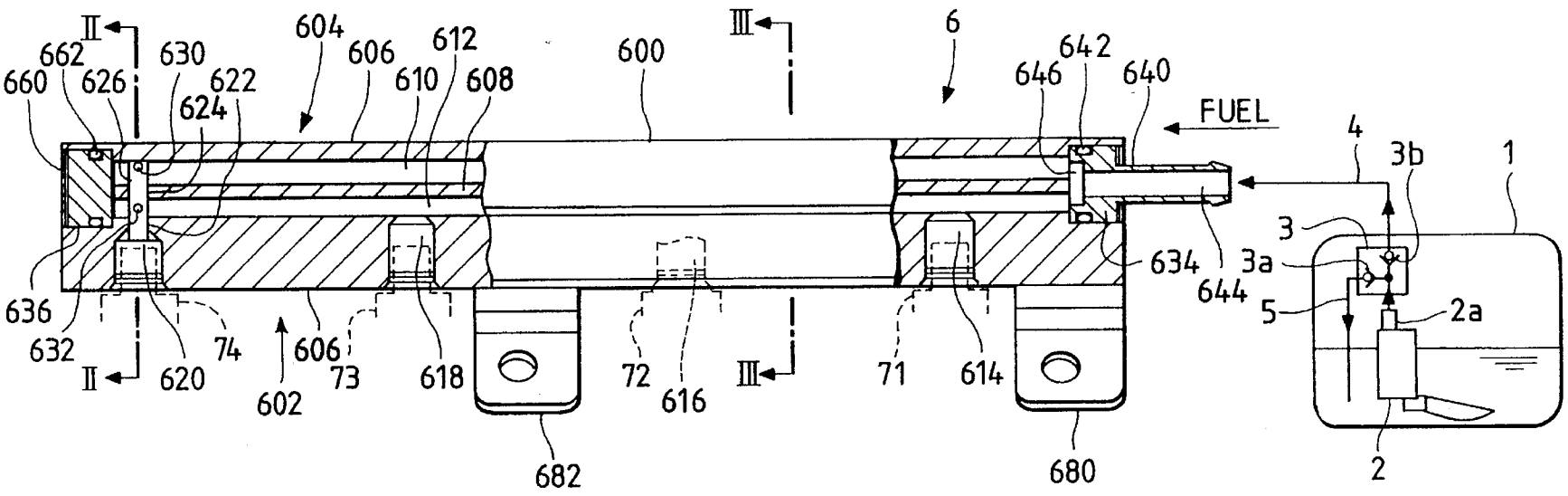
FIG. 1 is a diagram showing a fuel supply system with a partly-sectioned delivery pipe according to a first preferred embodiment of the present invention.
Figure 2:
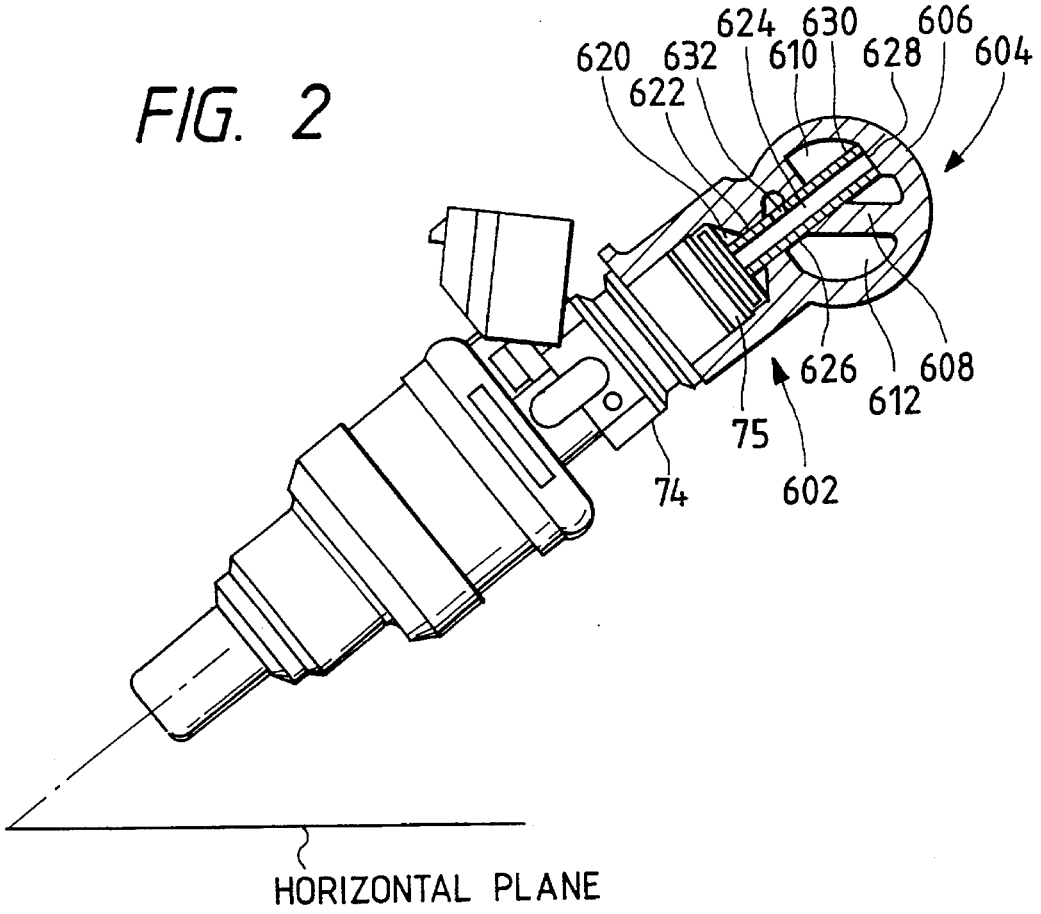
FIG. 2 is a sectional view taken along line II—II in FIG. 1.
Figure 3:
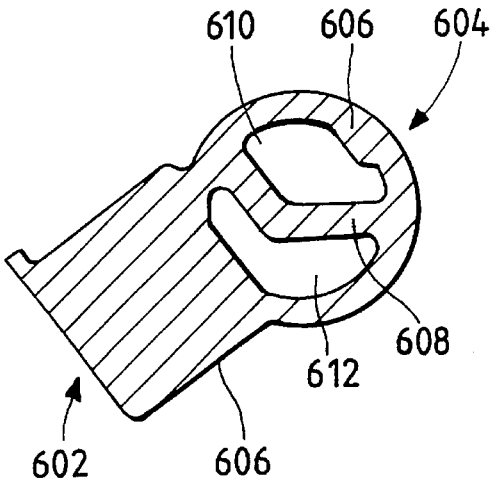
FIG. 3 is a sectional view taken along line III—III in FIG. 1.

With reference to FIGS. 1 to 3, a first preferred embodiment of the present invention will be described hereinbelow, wherein the present invention is applied to a fuel supply system for a four-cylinder internal combustion gasoline-engine for running an automotive vehicle.

FIG. 1 shows the fuel supply system with a partly-sectioned delivery pipe according to the first preferred embodiment, FIG. 2 is a sectional view taken along line II—II in FIG. 1, and FIG. 3 is a sectional view taken along line III—III in FIG. 1.

Fuel, i.e. gasoline is stored in a fuel tank 1 installed on the vehicle. The fuel is sucked and pressurized by an electric motor pump 2 and then discharged from a pump discharge port 2*a* into a fuel feed pipe 4. The fuel in the fuel feed pipe 4 is adjusted to a predetermined pressure by a pressure regulator 3 working as fuel pressure adjusting means. The pressure regulator 3 is arranged in the fuel tank 1 and includes a relief valve 3*a* for adjusting the fuel pressure and a check valve 3*b* for prohibiting a reverse flow of the fuel from the fuel feed pipe 4. Excess fuel is discharged in the fuel tank 1 via a return pipe 5 having the relief valve 3*a* therein.

In order to suppress an increase in the fuel temperature in the fuel tank 1, it is desirable that the fuel introduced near the engine via the fuel feed pipe 4 be supplied in its entirety to the engine. Accordingly, in this preferred embodiment, it is arranged that the fuel once flowing out of the fuel tank 1 is not returned to the fuel tank 1, but is all supplied to the engine.

A delivery pipe 6 working as fuel distributing means is connected to a downstream end of the fuel feed pipe 4. By means of the delivery pipe 6, the fuel is distributed to fuel injection valves 71, 72, 73 and 74.

In this preferred embodiment, the delivery pipe 6 has a function of gas-liquid separation, a function of fuel distribution and a function of selective supply of gas components (air, fuel vapor), which will be described later in detail.

The delivery pipe 6 has one end with an inlet and the other end which is closed. Specifically, the delivery pipe 6 has a main pipe 600, an inlet pipe 640 provided at one end of the main pipe 600 to be connected to the fuel feed pipe 4 and thus working as an inlet portion of the deliver pipe 6, and a cap 660 working as a closure member to close the other end of the main pipe 600.

The main pipe 600 includes a block section 602 where the fuel injection valves 71, 72, 73 and 74 are mounted, and a cylindrical section 604 where a first chamber or an upper chamber 610 working as a gas chamber and a second chamber or a lower chamber 612 working as a liquid chamber are formed.

The cylindrical section 604 includes a portion of an outer wall 606, and a partition wall 608 dividing the interior of the cylindrical section 606 to define the upper and lower chambers 610 and 612 therein. Accordingly, as best shown in FIG. 3, the cylindrical section 604 has a θ-shape in cross section.

The main pipe 600, including the block section 602 and the cylindrical section 604, is formed of an aluminum alloy by extrusion. The outer wall 606, the partition wall 608, the upper chamber 610 and the lower chamber 612 are formed at the time of extrusion and extend in a longitudinal direction of the main pipe 600. As shown in FIG. 2, when the delivery pipe 6 is mounted to the engine, the upper chamber 610 is located right above the lower chamber 612 relative to the gravity direction. Further, the upper and lower chambers 610 and 612 are located in a circular cross section of the cylindrical section 604. The inlet pipe 640 and the cap 660 may be formed of any suitable material.

The block section 602 is formed, by machining, with outlet portions 614, 616, 618 and 620 working as fuel passages to the fuel injection valves 71, 72, 73 and 74. Each of the outlet portions 614, 616 and 618 working as first fuel outlet potions penetrates the outer wall 606 to communicate only with the lower chamber 612. The outlet portion 620 working as a second fuel outlet portion is located most remote from the inlet pipe 640 among the outlet portions 614 to 620. The outlet portion 620 is in the form of a shallower or less-deep hole as compared with the other three outlet potions. Further, a first communication hole 622 is formed through the outer wall 606 to establish communication between the outlet portion 620 and the lower chamber 612. A second communication hole 624 is further formed through the partition wall 608 to establish communication between the upper and lower chambers 610 and 612. The second communication hole 624 is formed coaxial with the first communication hole 622.

A through pipe 626, as a passage member, is press-fit in the first and second communication holes 622 and 624 in a fluid-tight fashion. An upper end of the through pipe 626 is closed by a planar portion 628 formed on an inner surface of the outer wall 606 in the upper chamber 610 at the time of extrusion. A lower end of the through pipe 626 is opened to the space of the outlet portion 620 so as to work as an outlet opening. The through pipe 626 defines a first orifice 630, working as a first opening, and a second orifice 632, working as a second opening. The first orifice 630 is formed in the upper end of the through pipe 626, facing toward the uppermost portion of the upper chamber 610. The second orifice 632 is formed in an intermediate portion of the through pipe 626, facing toward the uppermost portion of the lower chamber 612. Accordingly, the through pipe 626 forms a first passage establishing communication between the lower chamber 612 and the outlet portion 620 via the second orifice 632, and a second passage establishing communication between the upper chamber 610 and the vicinity of an inlet (the second orifice 632) of the first passage via the first orifice 630.

A diameter of an inner passage of the through pipe 626, that is, of the first and second passages, and an open area of the first orifice 630 are set so that gas components are sucked from the upper chamber 610 reliably per given amount. This given amount may be set between an amount which allows an engine cylinder corresponding to the fuel injection valve 74 to continue the minimum combustion therein, and an amount which allows that engine cylinder to continue the combustion slightly poorer than the optimum combustion. On the other hand, in order to set the foregoing given amount, it is also important to adjust an open area of the second orifice 632 in addition to the adjustment of the diameter of the inner passage of the through pipe 626 and the open area of the first orifice 630.

A reception hole 634 is formed at the one end of the main pipe 600. In the reception hole 634, the inlet pipe 640 of a stepped cylindrical shape is mounted in a fluid-tight fashion using an O-ring 642. The inlet pipe 640 is fixed by means of a peripheral portion of the main pipe 600 by caulking.

The inlet pipe 640 includes a passage 644 connected to the fuel feed pipe 4, and a dividing chamber 646 for receiving the fuel supplied via the passage 644. The dividing chamber 646 communicates with both the upper and lower chambers 610 and 612. In the dividing chamber 646, the fuel supplied from the passage 644 is separated into gas components and liquid components, which are divided into the upper and lower chambers 610 and 612, respectively. The dividing chamber 646 and the upper and lower chambers 610 and 612 cooperatively form a gas-liquid separation chamber.

A reception hole 636 is formed at the other end of the main pipe 600. In the reception hole 636, the cap 660 of a cylindrical shape is mounted in a fluid-tight fashion using an O-ring 662. The cap 660 is fixed by means of a peripheral portion of the main pipe 600 by caulking.

In each of the outlet portions 614, 616, 618 and 620, the fuel injection valve is mounted in a fluid-tight fashion via an O-ring. One example is shown in FIG. 2, wherein the fuel injection valve 74 is mounted in the outlet portion 620 via the O-ring 75.

Further, mounting stays 680 and 682 are fixed to the block section 602 for mounting the delivery pipe 6 to the engine. Any suitable means may be used to for the mounting stays 680 and 682 to the block section 602.

Now, an operation of the first preferred embodiment will be described hereinbelow.

The fuel pressurized at the pump 2 and discharged therefrom is supplied via the fuel feed pipe 4 to the delivery pipe 6 provided near the engine. At this time, the fuel pressure in the fuel feed pipe 4 is adjusted to the given value by the pressure regulator 3 so that an excess portion of the fuel discharged from the pump 2 is returned in the fuel tank 1 without flowing out of the fuel tank, that is, without approaching high-temperature portions, such as, the engine and an exhaust pipe.

The fuel injection valves 71, 72, 73 and 74 are controlled to be opened or closed in response to respective control signals from a control unit (not shown) so as to inject the pressurized fuel introduced to the outlet portions 614, 616, 618 and 620 into intake passages leading to the corresponding engine cylinders.

Accordingly, in this preferred embodiment, the fuel flowing out of the fuel tank 1 is all supplied to the engine via the fuel injection valves.

At the first start-up of the engine after assembling thereof, the inside of the main pipe 600 is all filled up with air. The fuel entering the dividing chamber 646 via the passage 644 of the inlet pipe 640 is separated into gas components (air, fuel vapor) and liquid components (liquid fuel) in the dividing chamber 646 and the upper and lower chambers 610 and 612. The gas components are mainly collected in the upper chamber 610, and the liquid components are mainly collected in the lower chamber 612.

When the fuel injection valves are operated to be opened or closed at such first start-up of the engine, at the initial stage of the engine start-up, the gas components in the lower chamber 612 are first discharged via all the fuel injection valves so that the liquid fuel starts to flow into the lower chamber 612 from the dividing chamber 646, and the gas components move into the upper chamber 610 via the dividing chamber 646.

The liquid fuel flowing into the lower chamber 612 from the dividing chamber 646 flows into the outlet portions 614, 616 and 618 so as to be injected via the fuel injection valves 71, 72 and 73 for the engine. At this time, the second orifice 632 connecting the lower chamber 612 to the outlet portion 620 is still located above a level of the liquid fuel so that only the fuel injection valve 74 continues to discharge the gas components. Accordingly, three among four engine cylinders start the normal fuel injections in advance of the remaining one.

Thereafter, when the gas components remaining in the lower chamber 612 are discharged via the fuel injection valve 74, the liquid fuel is also supplied to the outlet portion 620 via the second orifice 632 so that the fuel injection valve 74 also starts injecting the liquid fuel. At this time, the gas components in the upper chamber 610 are sucked little by little or per slight amount into the through pipe 626 via the first orifice 630 and reach the outlet portion 620 along with the liquid fuel flowing in via the second orifice 632. The gas components are then discharged via the fuel injection valve 74 along with the liquid fuel. The flow of the gas components from the upper chamber 610 to the outlet portion 620 is generated due to a pressure differential between the upper chamber 610 and the outlet portion 620 and further due to a pressure differential between the upper chamber 610 and the lower chamber 612. These pressure differentials are temporally caused in response to a valve opening operation of the fuel injection valve 74.

Further, the second orifice 632 provides a throttling relative to the liquid fuel flowing therethrough so that the second orifice 632 and the inner passage of the through pipe 626 work as a venturi tube. Accordingly, the flow of the liquid fuel flowing into the through pipe 626 via the second orifice 632 generates a negative pressure to facilitate the flow of the gas components from the upper chamber 610 to the neighborhood of the second orifice 632.

When the gas components in the upper chamber 612 are all discharged, all the fuel injection valves inject only the liquid fuel.

As appreciated from the foregoing description, in this preferred embodiment, at the first start-up of the engine, the air in the delivery pipe 6 is discharged automatically. Further, since the discharge of the air is mainly performed only by the fuel injection valve 74, the remaining three cylinders can be quickly put in a condition to achieve the normal fuel injection amount therethrough so that the first start-up of the engine can be performed smoothly. Moreover, since the fuel injection valve 74 is arranged to discharge the gas components little by little or per slight amount as being mixed with the liquid components, a variation of the fuel injection amount for the engine cylinder corresponding to the fuel injection valve 74 can be suppressed to an extent which does not adversely affect the drivability of the vehicle on a practical basis.

When the fuel injection valve 74 discharges the gas components as being mixed with the liquid components, it may be arranged that a mixture ratio of the gas components and the liquid components allows the corresponding engine cylinder to continue the minimum combustion therein. However, it is more preferable that an amount of the gas components is limited to such a small value that does not affect the drivability of the vehicle as described above. When determining the mixture ratio of the gas components and the liquid components, the deterioration of exhaust gas emissions due to the deterioration of combustion in the corresponding cylinder should also be considered so as to suppress it as much as possible.

When increment of an atmospheric temperature or an engine temperature, or lowering of a fuel level in the fuel tank 1 occurs during an engine operation after the foregoing first start-up of the engine or after the second or further start-up of the engine, the fuel vapor may be generated in the delivery pipe 6 or the fuel mixed with the gas components (air, gaseous fuel) may be supplied via the fuel feed pipe 4.

In such a case, the gas components and the liquid components are separated vertically in the dividing chamber 646 so that the gas components are introduced into the upper chamber 610 while the liquid components are introduced into the lower chamber 612. The gas components introduced into the upper chamber 610 are sucked little by little into the through pipe 626 via the first orifice 630 and then discharged only via the fuel injection valve 74. Accordingly, the other three fuel injection valves 71, 72 and 73 are allowed to inject the liquid fuel supplied from the lower chamber 612 so that the normal fuel injection amount can be achieved therefrom. Further, the engine cylinder corresponding to the fuel injection valve 74 can also continue the combustion therein which does not adversely affect the drivability of the vehicle.

As appreciated from the foregoing description, even when the gas-liquid mixture fuel is supplied, the gas is discharged only from the fuel injection valve corresponding to one of the engine cylinders, that is, a part of the total engine cylinders, and further per slight amount. Accordingly, a reduction in fuel injection amount due to the gas components is limited to the part of the engine cylinders so that lowering of the output torque over the entire multi-cylinder engine upon discharge of the gas components is small. Further, since the combustion is deteriorated relative to the part of the total engine cylinders, the deterioration of the exhaust gas emissions is also small.

Similarly, even when the fuel vapor is produced to cause generation of bubbles in the lower chamber 612 during the engine operation, the gas-liquid separation is performed in the lower chamber 612 so that the gas components are discharged only through the fuel injection valve 74 via the second orifice 632.

Further, in a high-temperature state just after the engine is stopped, the whole delivery pipe 6 is heated to a high temperature due to the heat of the engine so as to generate the fuel vapor therein. Further, when the fuel in the delivery pipe flows back toward the fuel tank due to long-term stoppage of the engine, bubbles are generated in the delivery pipe 6. Even in these cases, the gas-liquid separation is performed both in the upper and lower chambers 610 and 612 so that the bubbles of the fuel vapor are collected at an upper side of each of the chambers. Further, a portion of the bubbles in the lower chamber 612 flows into the upper chamber 610 via the dividing chamber 646. Accordingly, the liquid fuel is supplied to the fuel injection valves 71, 72 and 73 for the three engine cylinders, while the gas is supplied only to the fuel injection valve 74 via the first and second orifices 630 and 632.

According to the foregoing first preferred embodiment, since the fuel flowing out of the fuel tank 1, particularly the fuel once supplied to the neighborhood of the engine, does not return to the fuel tank 1, the return of the high-pressure fuel to the fuel tank 1 can be prevented so as to suppress generation of the fuel vapor in the fuel tank 1.

Further, the delivery pipe 6 supplies the liquid fuel to the fuel injection valves 71, 72 and 73 with priority and performs the selective supply of the gas components formed of air and/or fuel vapor, that is, supplies the gas components only to the fuel injection valve 74. Accordingly, the reduction in fuel injection amount can be limited to the part of the multiple cylinders so that the torque reduction over the entire multi-cylinder engine and the deterioration of the exhaust gas emissions can be effectively suppressed.

Moreover, in addition to the foregoing selective supply of the gas components, the gas components are collected independently in the upper chamber 610, and further the gas components in the upper chamber 610 are discharged little by little and as being mixed with the liquid components. Accordingly, the substantially normal combustion can be maintained even in the engine cylinder corresponding to the fuel injection valve 74 which discharges the gas components, so that emissions of unburned components from that engine cylinder can be prevented.

Moreover, the outlet portion 620 communicates with the upper and lower chambers 610 and 612 via the first and second orifices 630 and 632 each working as a throttling, and further, the diameter of the inner passage of the through pipe 626 is set smaller as compared with a diameter of the outlet portion 620. Accordingly, the bubbles in the upper or lower chamber is reliably sucked and introduced into the outlet portion 620 by effectively using the pressure differential between the upper chamber 610 and the outlet portion 620 or between the lower chamber 612 and the outlet portion 620 so as to prevent the fuel injection from being stopped due to the generation of bubbles.

In the foregoing first preferred embodiment, the inside of the delivery pipe 6 is divided into the upper and lower chambers 610 and 612, the fuel injection valves 71, 72 and 73 communicate only with the lower chamber 612, and only the fuel injection valve 74 communicates with the upper chamber 610. This arrangement allows the selective supply of the gas components, that is, the supply of the gas components only to the part of the engine cylinders.

Further, since the first and second orifices 630 and 632 each communicating with the fuel injection valve 74 are opened toward the upper space of the upper and lower chambers 610 and 612, respectively. This arrangement ensures the reliable supply of the gas components to the fuel injection valve 74.

Moreover, the outlet portions 614, 616 and 618 to the fuel injection valves 71, 72 and 73 are arranged to communicate with the lower chamber 612 at the bottom thereof. This arrangement ensures the reliable supply of the liquid fuel to the corresponding engine cylinders via the fuel injection valves 71, 72 and 73.

Moreover, in the first preferred embodiment, the main pipe 600 including the upper and lower chambers 610 and 612 therein is formed by the extrusion so as to be in the form of an extruded integral body. Accordingly, the production of the main pipe 600 is simple and easy. Further, since the upper and lower chambers 610 and 612 are located within the circular cross section of the cylindrical section 604, the axial end of the delivery pipe 6 can be closed by the member 660 having a circular cross section. This makes the production of the delivery pipe simple and easy. Further, since the through pipe 626 penetrating the partition wall 608 is used to form the foregoing first and second passages to the fuel injection valve 74, those passages can be easily formed. This also makes the production of the delivery pipe simple and easy.

Now, a second preferred embodiment of the present invention will be described hereinbelow with reference to FIG. 4, wherein the same or like elements are designated by the same reference marks as those in the first preferred embodiment.

Figure 4:
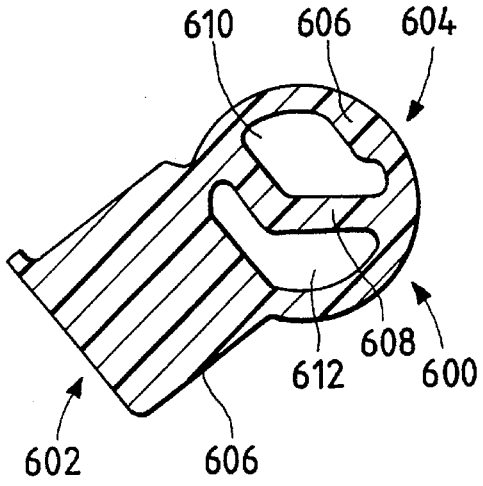
FIG. 4 is a sectional view, corresponding to FIG. 3, showing a delivery pipe for use in a fuel supply system according to a second preferred embodiment of the present invention.

FIG. 4 is a sectional view showing a delivery pipe for use in a fuel supply system according to the second preferred embodiment. The second preferred embodiment differs from the first preferred embodiment in that the main pipe 600 is formed of resin. Using resin, the main pipe 600 may be less weighted and less costly.

The other structure is the same as that in the first preferred embodiment.

Now, a third preferred embodiment of the present invention will be described hereinbelow with reference to FIG. 5, wherein the same or like elements are designated by the same reference marks as those in the first preferred embodiment.

Figure 5:
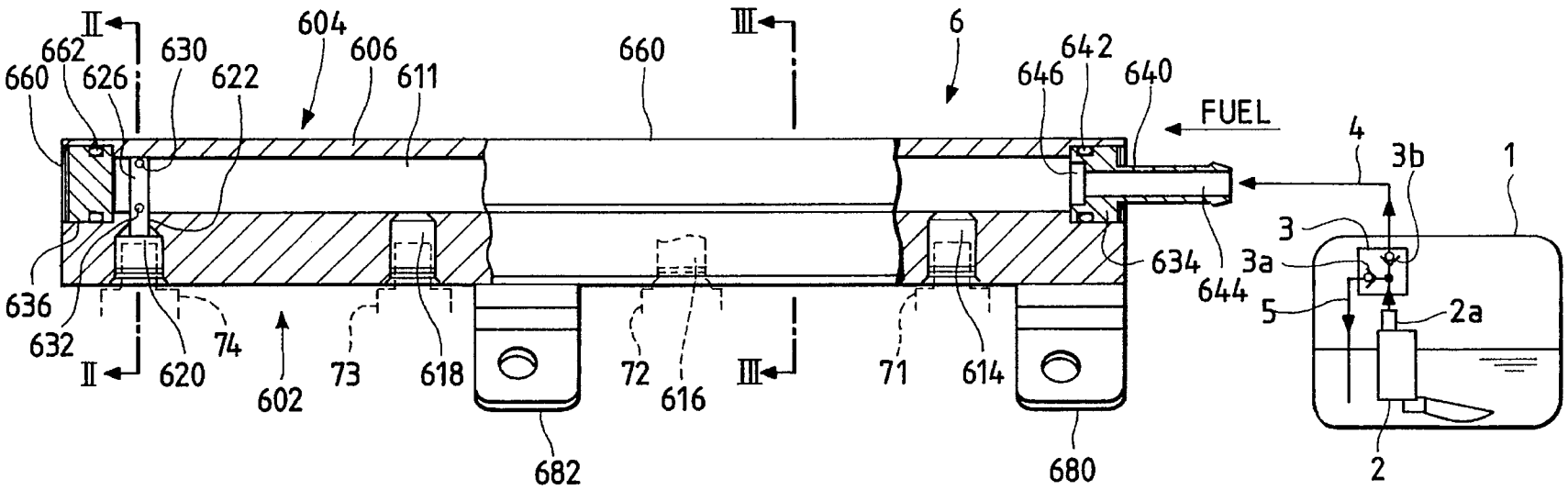
FIG. 5 is a diagram showing a fuel supply system with a partly-sectioned delivery pipe according to a third preferred embodiment of the present invention.

FIG. 5 shows a fuel supply system with a partly-sectioned delivery pipe according to the third preferred embodiment. The third preferred embodiment differs from the first preferred embodiment in a structure of the delivery pipe 6.

Specifically, as shown in FIG. 5, in the third preferred embodiment, the partition wall 608 in the first preferred embodiment is omitted so that the cylindrical section 604 has an O-shaped cross section. Accordingly, only one chamber 611 is defined inside the cylindrical section 604 instead of the upper and lower chambers 610 and 612 in the first preferred embodiment. As seen in FIG. 5, the through pipe 626 is press-fit in the communication hole 622 in a fluid-tight fashion. An upper end of the through pipe 626 is closed by an inner surface of the outer wall 606 in the chamber 611. The first orifice 630 is located at an upper area of the chamber 611, and the second orifice 632 is located at a lower area of the chamber 611.

In the third preferred embodiment, the gas components are mainly collected at the upper area of the chamber 611, and the liquid components are mainly collected at the lower area of the chamber 611.

The other structure is the same as that in the first preferred embodiment.

In the third preferred embodiment, like in the first preferred embodiment, the gas components at the upper area of the chamber 611 are sucked little by little or per slight mount into the through pipe 626 via the first orifice 630 and reach the outlet portion 620 along with the liquid fuel flowing via the second orifice 632 to be discharged via the fuel injection valve 74 along with the liquid fuel.

Now, a fourth preferred embodiment of the present invention will be described hereinbelow with reference to FIGS. 6 to 8, wherein the same or like elements are designated by the same reference marks as those in the first preferred embodiment.

Figure 6:
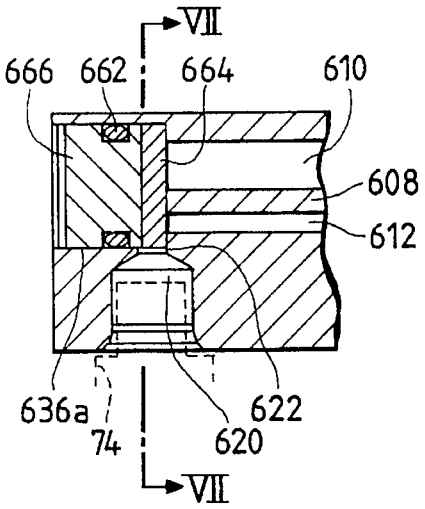
FIG. 6 is a sectional view showing a main portion of a delivery pipe for use in a fuel supply system according to a fourth preferred embodiment of the present invention.
Figure 7:
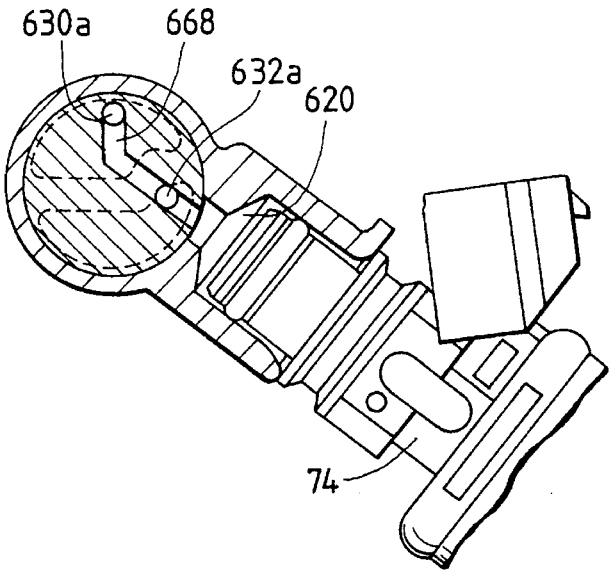
FIG. 7 is a sectional view taken along line VII—VII in FIG. 6.
Figure 8:
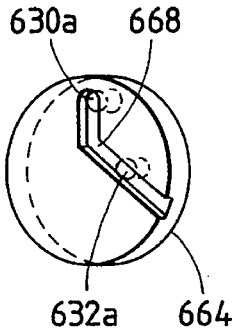
FIG. 8 is a perspective view showing a spacer plate used in the delivery pipe of FIG. 6.

FIG. 6 shows a main portion of a delivery pipe for use in a fuel supply system according to the fourth preferred embodiment, FIG. 7 is a sectional view taken along line VII—VII in FIG. 6, and FIG. 8 shows a spacer plate used in the delivery pipe of FIG. 6. The fourth preferred embodiment differs from the first preferred embodiment in a passage structure for establishing communication between the upper and lower chambers 610 and 612 and the fuel injection valve 74 and in a shape of the partition wall 608.

Specifically, in the fourth preferred embodiment, a passage communicating with both the upper and lower chambers 610 and 612 is formed by members closing the axial end of the main pipe 600 of the delivery pipe 6.

A reception hole **636*a* reaching the communication hole 622 is formed at the axial end of the main pipe 600. In the reception hole 636*a* are mounted a spacer plate 664 and a cap 666. As shown in FIG. 8, the spacer plate 664 is formed with a groove 668 at a side thereof facing the cap 666. The spacer plate 664 is further formed with a first orifice 630*a* extending from the groove 668 to be opened to an upper area of the upper chamber 610 and a second orifice 632*a* extending from the groove 668 to be opened to an upper area of the lower chamber 612. The groove 668 forms a passage between the cap 666 and the spacer plate 664 to connect the outlet portion 620 to both the upper and lower chambers 610 and 612. Like the cap 660 in the first preferred embodiment, the cap 666 is mounted in a fluid-tight fashion using the O-ring 662**.

The other structure is the same as that in the first preferred embodiment.

In the fourth preferred embodiment, like in the first preferred embodiment, the gas components are supplied from the upper chamber 610 only to the outlet portion 620. Further, in the fourth preferred embodiment, the mounting of the through pipe as in the first preferred embodiment can be omitted.

In order to fix a positional relationship between the first and second orifices 630 and 632 and the upper and lower chambers 610 and 612, a positioning projection or groove may be provided for positioning the spacer plate 664 relative to the main pipe 600. Further, it may be arranged that the cap 666 is formed with the groove 668, and the spacer plate 664 is formed only with the first and second orifices.

Now, a fifth preferred embodiment of the present invention will be described hereinbelow with reference to FIGS. 9 to 11, wherein the same or like elements are designated by the same reference marks as those in the fourth preferred embodiment.

Figure 9:
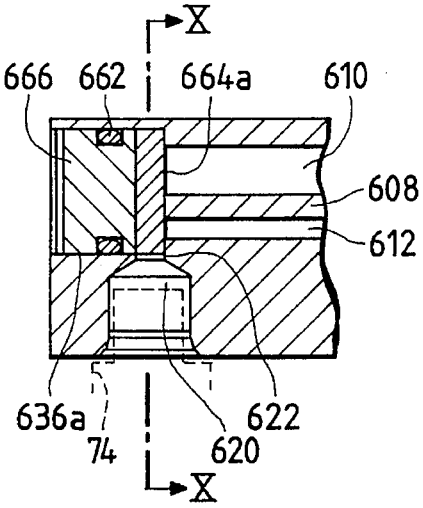
FIG. 9 is a sectional view showing a main portion of a delivery pipe for use in a fuel supply system according to a fifth preferred embodiment of the present invention.
Figure 10:
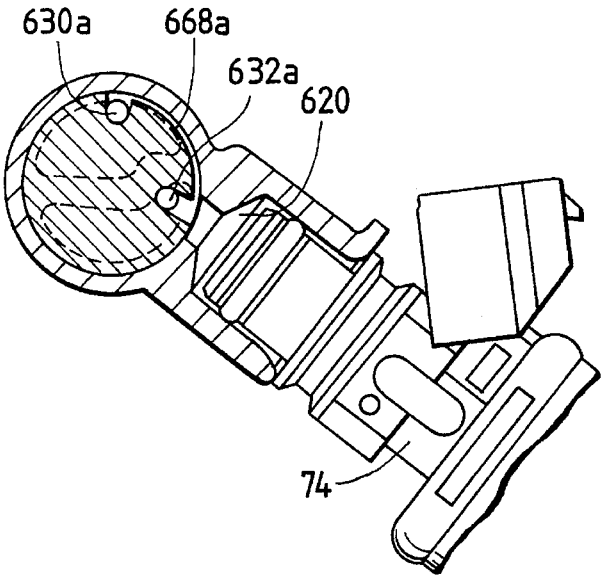
FIG. 10 is a sectional view taken along line X—X in FIG. 9.
Figure 11:
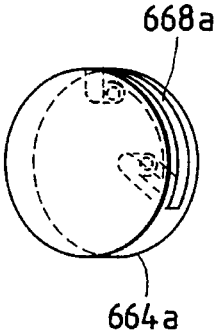
FIG. 11 is a perspective view showing a spacer plate used in the delivery pipe of FIG. 9.

FIG. 9 shows a main portion of a delivery pipe for use in a fuel supply system according to the fifth preferred embodiment, FIG. 10 is a sectional view taken along line X—X in FIG. 9, and FIG. 11 shows a spacer plate used in the delivery pipe of FIG. 9. The fifth preferred embodiment differs from the fourth preferred embodiment in a structure of the spacer plate.

Specifically, as shown in FIG. 11, in the fifth preferred embodiment, a spacer plate **664*a* is formed with a groove 668*a* extending along the circumference or outer periphery thereof. The spacer plate 664*a* is further formed with a first orifice 630*a* connecting the groove 668*a* to an upper area of the upper chamber 610 and a second orifice 632*a* connecting the groove 668*a* to an upper area of the lower chamber 612. The groove 668*a*** forms a passage between the spacer plate 664*a* and the main pipe 600 and connects the outer portion 620 to both the upper and lower chambers 610 and 612.

The other structure is the same as that in the fourth preferred embodiment.

In the fifth preferred embodiment, like in the first preferred embodiment, the gas components are supplied from the upper chamber 610 only to the outlet portion 620. Further, in the fifth preferred embodiment, like in the fourth preferred embodiment, the mounting of the through pipe as in the first preferred embodiment can be omitted.

Now, a sixth preferred embodiment of the present invention will be described hereinbelow with reference to FIG. 12, wherein the same or like elements are designated by the same reference marks as those in the first preferred embodiment.

Figure 12:
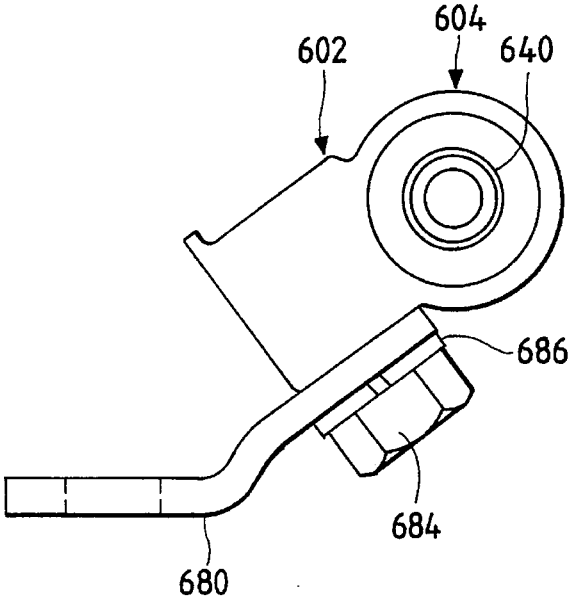
FIG. 12 is a diagram showing a structure of fixing mounting stays to a block section of a main pipe of a delivery pipe according to a sixth preferred embodiment of the present invention.

FIG. 12 shows one example of the mounting manners for fixing the mounting stays 680 and 682 (only the mounting stay 680 is shown in the figure) to the block section 602 of the main pipe 600. FIG. 12 corresponds to a view seeing the delivery pipe 6 from a right side In FIG. 1. As appreciated from FIG. 12, the mounting stay 680 (682) is mounted to the block section 602 by means of a bolt 684 and a spring washer 686.

Now, a seventh preferred embodiment of the present invention will be described hereinbelow with reference to FIG. 13, wherein the same or like elements are designated by the same reference marks as those in the first preferred embodiment.

Figure 13:
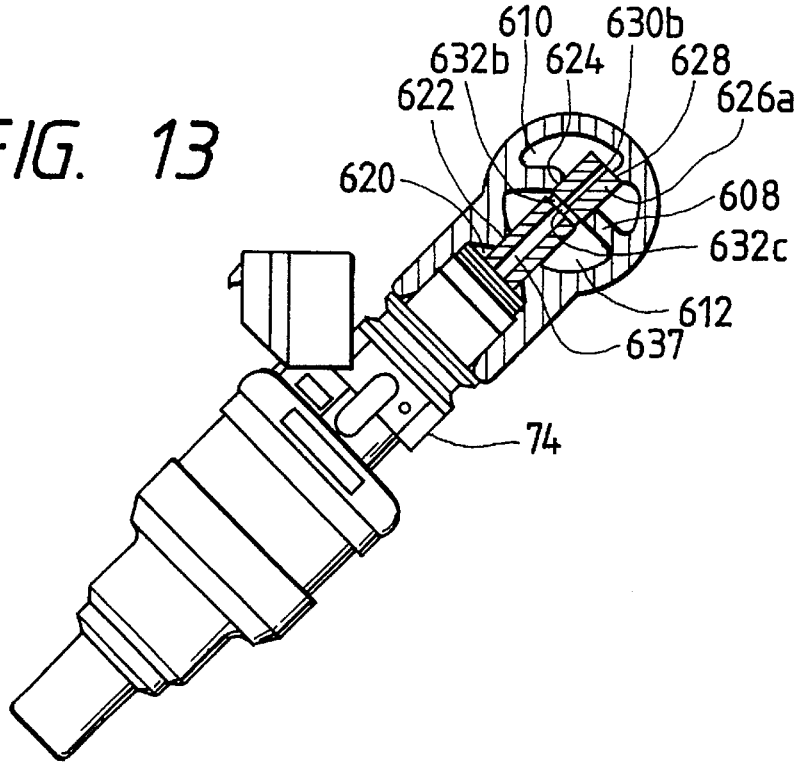
FIG. 13 is a sectional view, corresponding to FIG. 2, showing a fuel supply system according to a seventh preferred embodiment of the present invention.

FIG. 13 is a sectional view, corresponding to FIG. 2, showing a fuel supply system according to the seventh preferred embodiment. The seventh preferred embodiment differs from the first preferred embodiment in a structure of the delivery pipe 6, particularly in a passage structure for establishing communication between the upper and lower chambers 610 and 612 and the fuel injection valve 74. The other structure is the same as that in the first preferred embodiment.

The seventh preferred embodiment aims to prevent adverse affection to an air-fuel ratio in the engine due to the gas components supplied from the upper chamber 610 and discharged via the fuel injection valve 74.

Figure 16:
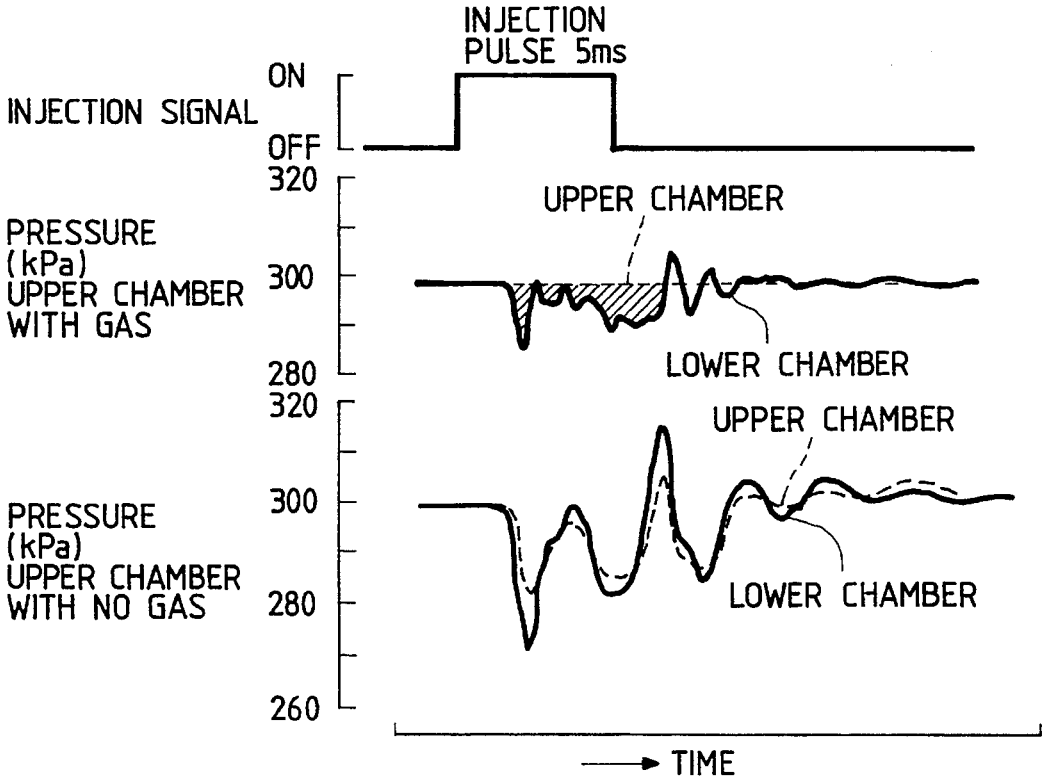
FIG. 16 is a diagram showing time-domain pressure variations in upper and lower chambers of a delivery pipe In terms of a fuel injection signal.

FIG. 16 shows time-domain pressure variations in the upper and lower chambers 610 and 612 in terms of the operation of the fuel injection valve 74 controlled by a fuel injection signal from the control unit.

As shown in FIG. 16, pressures in the upper and lower chambers 610 and 612 vary in response to the valve opening of the fuel injection valve 74. As further shown in FIG. 16, the pressure variations in the upper and lower chambers 610 and 612 differ depending on presence or absence of the gas components in the upper chamber 610. Specifically, when the upper chamber 610 is filled with the gas components, the pressure variations both in the upper and lower chamber 610 and 612 are smaller as compared with the case where no gas components exist in the upper chamber 610. Particularly, the pressure variation in the upper chamber 610 is quite small and held almost constant due to the presence of the gas components therein even when the liquid fuel is sucked out from the lower chamber 612 in response to the valve opening of the fuel injection valve 74. Accordingly, large pressure differentials are generated between pressure values in the upper and lower chambers 610 and 612 as represented by hatched portions in FIG. 16. Such pressure differentials allow the gas components to be discharged from the upper chamber 610 and sucked into the fuel injection valve 74 via a through pipe 626*a* to be discharged therefrom.

In FIG. 13, the through pipe 626*a* is press-fit in the first and second communication holes 622 and 624 in a fluid-tight fashion. An upper end of the through pipe 626*a* is partly supported by the planar portion 628 formed in the upper chamber 610 at the time of extrusion. The through pipe 626*a* is formed with a first passage 630*b* forming a first opening communicating with the upper chamber 610 at an upper area thereof. The through pipe 626*a* is further formed with a second passage 637 having a lower end which is opened to the space of the outlet portion 620 so as to work as an outlet opening. Each of the first and second passages 630*b* and 637 extends along an axis of the through pipe 626*a*. The through pipe 626*a* is further formed at a boundary between the first and second passages 630*b* and 637 with third and fourth passages 632*b* and 632*c* which establish communication between the first and second passages 630*b* and 637. The third and fourth passages 632*b* and 632*c* are orthogonal to each other and further to the axis of the through pipe 626*a*, that is, to the first and second passages 630*b* and 637. Each of the third and fourth passages 632*b* and 632*c* has opposite ends both opened to upper areas in the lower chamber 612 so as to work as second openings. A diameter of the second passage 637 is set greater than that of the first passage 630*b* and determined based on, such as, output values of the engine and flow rates of the fuel injection valves 74.

Figure 15:
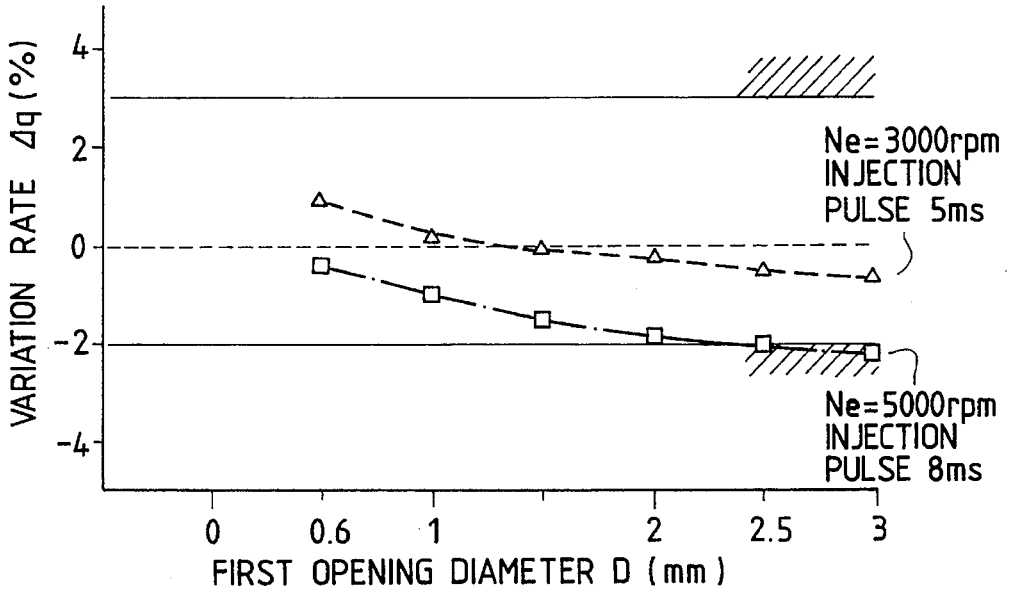
FIG. 15 is a diagram showing a variation rate of a dynamic injection amount In terms of a diameter of a first opening of a through pipe and further In terms of an engine speed.

As shown in FIG. 15, it is preferable that a variation rate $\Delta q$ of a dynamic injection amount q at the fuel injection valve 74 is $-2\% \leqq \Delta q \leqq 3\%$ at the normal engine speed of 3,000 rmp~5,000 rmp. As an engine speed increases, a valve opening time of the fuel injection valve is prolonged. This increases a rate of sucking the gas components as compared with that of sucking the liquid components so that the variation rate $\Delta q$ of the dynamic injection amount q is diminished. Accordingly, it is preferable that $\Delta q \geqq -2\%$ is ensured at the maximum value of the normal engine speed, that is, at 5,000 rpm. By ensuring $-2\% \leqq \Delta q \leqq 3\%$, the air-fuel ratio in the engine can be held substantially constant to maintain the good engine operation.

For ensuring $-2\% \leqq \Delta q \leqq 3\%$, it is preferable that a diameter D of the first opening or passage 630*b* of the through pipe 626*a* is set equal to or smaller than 2.5 mm. If $D \geqq 2.5$ mm, the dynamic fuel injection amount variation rate $\Delta q$ becomes smaller than $-2\%$ when the engine speed exceeds 5,000 rpm. On the other hand, it is preferable that the diameter D of the first passage 630*b* is set equal to or greater than 0.6 mm. If $D \leqq 0.6$ mm, processing of the through pipe 626*a* becomes difficult.

It is further preferable that the diameter D of the first passage 630*b* is 0.8 mm$\leqq D \leqq$1.0 mm. By setting D to a value between 0.8 mm and 1.0 mm, the dynamic injection amount variation rates $\Delta q$ can be dose to 0 (zero) at 5,000 rmp representing the maximum value of the normal engine speed, and further, can be substantially 0 (zero) at 3,000 rmp representing the frequently-used engine speed.

In this preferred embodiment, the diameter D of the first passage 630*b* is set to 0.8 mm.

Now, an eighth preferred embodiment of the present invention will be described hereinbelow with reference to FIG. 14, wherein the same or like elements are designated by the same reference marks as those in the seventh preferred embodiment.

Figure 14:
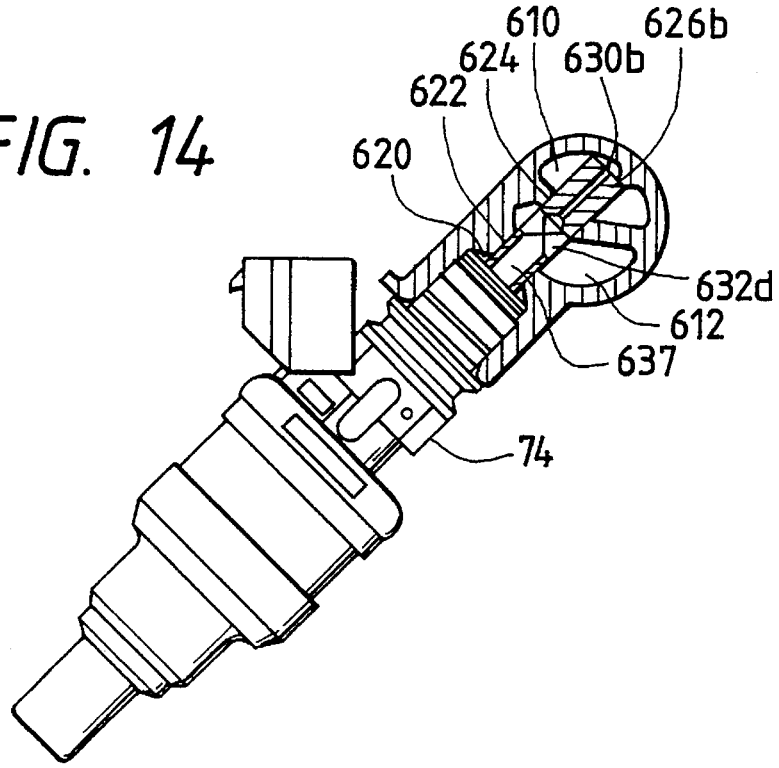
FIG. 14 is a sectional view, corresponding to FIG. 2, showing a fuel supply system according to an eighth preferred embodiment of the present invention.

FIG. 14 is a sectional view, corresponding to FIG. 2, showing a fuel supply system according to the eighth preferred embodiment. The eighth preferred embodiment differs from the seventh preferred embodiment in a structure of the delivery pipe 6, particularly in a passage structure for establishing communication between the upper and lower chambers 610 and 612 and the fuel injection valve 74. The other structure is the same as that in the seventh preferred embodiment.

In the eighth preferred embodiment, a diameter of the first passage 630*b* is set to 1.0 mm. A third passage 632*d* is formed at a boundary between the first and second passages 630*b* and 637 and establishes communication between the first and second passages 630*b* and 637. The third passage 632*d* extends orthogonal to an axis of a through pipe 626*b*, that is, to the first and second passages 630*b* and 637, and is opened to upper areas in the lower chamber 612 at opposite ends thereof.

In the foregoing preferred embodiments, the main pipe 600 has a θ-shape or an O-shape in cross section. On the other hand, the main pipe 600 may have a rectangular shape in cross section with or without the partition wall. The main pipe 600 may also have an 8-shape in cross section. In the latter case, a closure member may be provided for each of upper and lower chambers.

Further, the dividing chamber 646 provided at the inlet pipe 640 may be made larger in volume. A proper baffle plate may be provided at the dividing chamber 646 to prevent the gas components from flowing into the liquid side more positively.

Further, a gas-liquid separation container assembled separately may be coupled at the inlet side of the delivery pipe. When the gas-liquid separation container is sufficiently large, it is possible that the chamber for the gas is located below the chamber for the liquid.

In the foregoing preferred embodiments, the inlet pipe 640 is connected at the end of the delivery pipe 6. On the other hand, the inlet pipe 640 may be connected at the middle portion of the delivery pipe 6.

In view of the gas-liquid separation, it is desirable that the outlet for discharging the gas components is located most remotely from the fuel inlet. However, the outlet for the gas components may be located near the fuel inlet. It may further be arranged that the gas components are discharged via a plurality of the outlets.

Further, for ensuring generation of the pressure differential between the upper and lower chambers 610 and 612 caused by the opening/closing operation of the fuel injection valve, a proper throttling may be formed, such as, between the outlet portions 618 and 620 or at a communication portion between the upper and lower chambers.

In the foregoing preferred embodiments, the delivery pipe adapted for the top feed type fuel injection valve has been described. However, the present invention may also be applied to a delivery pipe adapted for the bottom feed type fuel injection valve.

Further, in the foregoing preferred embodiments, no return passage from the delivery pipe to the fuel tank is provided. However, a relief valve which only opens when a fuel pressure in the delivery pipe reaches an abnormally high pressure may be provided at the delivery pipe, and a corresponding return passage may be provided for emergent discharge of the fuel to the fuel tank. Even with this arrangement, since the excess fuel is prevented from returning to the fuel tank under the normal driving, the generation of the fuel vapor can be largely suppressed.

The present invention is applicable to a fuel supply system having a plurality of fuel injection valves as fuel outlet means. For example, the present invention may be applied to a fuel supply system for a multi-cylinder engine, wherein at least one fuel injection valve is provided for each engine cylinder. The present invention may also be applied to a fuel supply system for a multi-cylinder engine, wherein at least two fuel injection valves are provided at a junction of an intake manifold. The present invention may further be applied to a fuel supply system even for a single-cylinder engine, wherein at least two fuel injection valves are provided for a single cylinder.

Further, the present invention is applicable to a fuel supply system not only for a gasoline engine, but also for an engine using a liquid, such as, light oil or alcohol as fuel. Moreover, the present invention is applicable not only to a fuel supply system where fuel is supplied to an intake passage leading to an engine cylinder, but also to a fuel supply system where fuel is directly injected into a combustion chamber of an engine cylinder.

It is to be understood that this invention is not to be limited to the preferred embodiments and modifications described above, and that various changes and modifications may be made without departing from the spirit and scope of the invention as defined in the appended claims.

What is claimed is:

1. A fuel supply system for supplying pressurized fuel to an internal combustion engine, comprising:

a chamber member defining a gas-liquid separation chamber having an first portion and a second portion, said separation chamber being constructed and arranged to accept pressurized fuel and to separate liquid components and gas components contained in the pressurized fuel;

fuel outlet means, communicating with the second portion of said gas-liquid separation chamber, for supplying the fuel to said engine; and a passage member having a passage formed therein, said member being disposed within both the first portion and the second portion and operatively connected to said fuel outlet means such that the passage communicates with said fuel outlet means, said passage member also having a first opening establishing communication between said passage and said first portion, and a second opening establishing communication between said passage and said second portion, said passage member being constructed and arranged to supply the fuel within said first portion through the first opening, into the passage, and into said fuel outlet means, and to supply the fuel within said second portion through the second opening, into the passage, and into said fuel outlet means.

2. The fuel supply system as set forth in claim 1, wherein said gas-liquid separation chamber member includes an inlet portion constructed and arranged to introduce the pressurized fuel into the separation chamber, said separation chamber member being a tubular member extending from said inlet portion and having an integral partition wall, said partition wall divides an interior of said tubular member into said first portion and said second portion, said first portion communicates with a top portion of said inlet portion and said second portion communicates with a bottom portion of said inlet portion, and wherein said fuel outlet means communicates only with said second portion.

3. The fuel supply system as set forth in claim 2, wherein said first and second portions are arranged such that said first portion is located above said second portion when said tubular member is mounted to said engine.

4. The fuel supply system as set forth in claim 3, wherein said tubular member is formed of an aluminum alloy by extrusion.

5. The fuel supply system as set forth in claim 3, wherein said tubular member is formed of resin.

6. The fuel supply system as set forth in claim 4, wherein said passage member is a single pipe penetrating said partition wall and extending into said first and second portions.

7. The fuel supply system as set forth in claim 6, further comprising a fuel injection valve operatively connected to said fuel outlet means.

8. The fuel supply system as set forth in claim 7, further comprising a fuel feed pipe connected to said inlet portion such that the pressurized fuel is supplied to the system from a fuel tank via the fuel feed pipe, and wherein the pressurized fuel supplied via said fuel feed pipe is prohibited from returning to the fuel tank.

9. The fuel supply system as set forth in claim 8, wherein a diameter of said first opening is between 0.6 mm and 2.5 mm.

10. The fuel supply system as set forth in claim 8, wherein the diameter of said first opening is between 0.8 mm and 1.0 mm.

11. A delivery pipe for distributing pressurized fuel to first and second fuel injection valves arranged at a given interval therebetween, comprising:

an inlet portion constructed and arranged to receive the pressurized fuel;

a first portion having a first chamber, said first chamber communicating with an upper portion of said inlet portion;

a second portion having a second chamber, said second chamber communicating with a lower portion of said inlet portion and extending over said first and second fuel injection valves;

a first fuel outlet portion communicating only with said second chamber and supplying the fuel from said second chamber to said first fuel injection valve; and a second fuel outlet portion communicating with both said first and second chambers and supplying the fuel from both said first and second chambers to said second fuel injection valve.

12. The delivery pipe as set forth in claim 11, wherein a tubular outer wall is provided, said tubular outer wall extending over said first and second fuel injection valves, wherein a partition wall is provided, said partition wall formed integral with said tubular outer wall and dividing an interior space of said tubular outer wall into said first and second chambers, said first chamber being located above said second chamber when said tubular outer wall is mounted to an engine, wherein said first fuel outlet portion includes a passage penetrating said tubular outer wall to communicate with said second chamber, and wherein said second fuel outlet portion includes a first passage penetrating said tubular outer wall to communicate with said second chamber, said second fuel outlet portion further including a passage member forming a second passage establishing communication between said first chamber and said first passage.

13. The delivery pipe as set forth in claim 12, wherein a main pipe is provided, said main pipe being in the form of said tubular outer wall and said partition wall formed integral with each other, wherein a single closure member is provided, said closure member mounted at one end of said main pipe and closing respective ends of said first and second chambers, and wherein said inlet portion is connected at the other end of said main pipe to receive the pressurized fuel from a fuel tank, said inlet portion forming a gas-liquid separation chamber for introducing gas components of the fuel into said first chamber and liquid components of the fuel into said second chamber.

14. A delivery pipe for distributing pressurized fuel to a plurality of fuel injection valves, comprising:

a tubular main pipe formed of an aluminum alloy by extrusion, said main pipe having an interior which is divided by a partition wall into first and second chambers, said first chamber being located above said second chamber when said main pipe is mounted to an engine;

a closure member closing said first and second chambers at an end of said main pipe;

an inlet pipe constructed and arranged to receive the pressurized fuel, said inlet pipe connected to said main pipe so as to communicate with both said first and second chambers;

a first fuel outlet portion provided at said main pipe, said first fuel outlet portion communicating only with said second chamber so as to supply the fuel from said second chamber to a first fuel injection valve; and a second fuel outlet portion provided at said main pipe, said second fuel outlet portion communicating with both said first and second chambers so as to supply the fuel from both said first and second chambers to a second fuel injection valve.

15. The delivery pipe as set forth in claim 14, further comprising a fuel feed pipe connected to said inlet pipe such that the pressurized fuel is supplied to the system from a fuel tank via the fuel feed pipe, and wherein the pressurized fuel supplied via said fuel feed pipe is prohibited from returning to the fuel tank.

16. The delivery pipe as set forth in claim 15, wherein said second fuel outlet portion defines an opening communicating with said first chamber having a diameter between 0.6 mm and 2.5 mm.

17. The delivery pipe as set forth in claim 15, wherein said second fuel outlet portion defines an opening communicating with said first chamber having a diameter between 0.8 mm and 1.0 mm.

* * * * *